US005364292A

United States Patent [19]

Bethurum

[11] Patent Number: 5,364,292

[45] Date of Patent: Nov. 15, 1994

[54] CABLE HARNESS ASSEMBLY FOR IC CARD

[75] Inventor: Gary C. Bethurum, Laguna Niguel, Calif.

[73] Assignee: ITT Corporation, Secaucus, N.J.

[21] Appl. No.: 168,115

[22] Filed: Dec. 15, 1993

[51] Int. Cl.[5] ..... H01R 13/648

[52] U.S. Cl. ..... 439/610; 439/88; 439/931

[58] Field of Search ..... 439/98, 99, 610, 86, 439/88, 89, 931, 607

[56] References Cited

U.S. PATENT DOCUMENTS

| | | | |
|---|---|---|---|
| 3,744,128 | 7/1973 | Fisher et al. | 29/629 |
| 4,786,257 | 11/1988 | Tengler | 439/76 |
| 4,889,497 | 12/1989 | Riches | 439/76 |
| 4,929,195 | 5/1990 | Seidoh | 439/88 |
| 5,114,364 | 5/1992 | Hunter | 439/497 |
| 5,244,397 | 9/1993 | Anhalt | 439/101 |

FOREIGN PATENT DOCUMENTS

| | | | |
|---|---|---|---|
| 4109863 | 10/1992 | Germany | 439/610 |

*Primary Examiner*—Gary F. Paumen
*Attorney, Agent, or Firm*—Thomas L. Peterson

[57] ABSTRACT

A cable harness assembly is provided, which has a low profile, is shielded, and can be constructed at low cost. The assembly is of the type that includes a board (12, FIG. 2) coupled to a connector frame (14) that holds multiple contacts (52) and coupled to a cable (16), wherein insulated wires (24) of the cable run along the board and have bared front ends (50) connected at joints (74) to tails at the rear of the contacts. An underlayer (72) of electrically insulative material lies over the wire-to-tail joints and any other exposed areas of the wires and tails lying on the board, the underlayer having undulations (78, FIG. 3) that follow the contours under it. An overlayer (80, FIG. 2) of electrically conductive plastic material lies over the underlayer and the rest of the board, wires, and cable front portion. The overlayer is connected to the cable shield (30) and provides EMI-/ESD shielding, provides tough mechanical holding together of the harness assembly parts, and forms the outline of the assembly rearward of the connector frame.

12 Claims, 4 Drawing Sheets

CABLE HARNESS ASSEMBLY FOR IC CARD

BACKGROUND OF THE INVENTION

Miniature cable harness assemblies are commonly used to connect to input/output ports at the rear of IC (integrated circuit) Cards. A common design for a harness assembly includes a connector frame holding multiple contacts, a circuit board extending rearward of the connector frame, and a stripped cable held to the rear of the board. A row of conductive traces lie at the front of the board, and insulated wires of the cable extend to the traces. The bared front end of each wire is soldered to a trace, and tail of each contact is also soldered to a trace, to form a joint that connects them. After the joints are made, the assembly is placed in mold and insulative plastic is molded around the joints and wires to form a first molded layer. Then a layer of copper foil is wrapped round the first layer and the braided shielding of the cable is soldered to the foil. Finally, the assembly is placed in an overmold in which insulative plastic is injected to surround the foil and shielding and to form the outline of the harness assembly. The need to apply three layer over the initial assembly of board, wires, contact tails, and joints, with two of the layers being injection molded and one of them being a foil wrap, add to the cost and bulk of the assembly. Each of the two injection molding steps adds to the cost due to the dies and injection molding time, while the handling of foil wrapping adds additional costs. A compact cable harness assembly which could be constructed at low cost would be of value.

SUMMARY OF THE INVENTION

In accordance with one embodiment of the present invention, a cable harness assembly and construction method are provided, which results in a compact, low cost, and sturdy assembly. The assembly comprises a board, a connector frame at the front portion of the board, and a stripped cable end at the rear portion of the board. Insulated cable wires having bared front ends are connected in joints to tails of contacts in the connector frame. The joints and exposed areas of the wires and tails are covered by a preferably moldless underlayer of insulative material that may be applied by spraying or painting on, rather than by injection molding (although this can be used) so the underlayer follows the contours of parts it covers. The underlayer preferably does not cover the rear portion of the board where the cable braiding lies. A molded overlayer of electrically conductive largely polymeric material is molded around the underlayer as well as the board and front portion of the cable. The conductive polymeric material provides tough mechanical holding of the parts together, is electrically connected to the cable shielding to provide a grounded shield around the rest of the assembly for ESD/EMI (electrostatic discharge/electromagnetic interference) shielding, and forms the outline of the assembly. The assembly therefore requires only a single molding (of the overlayer), with the underlayer being capable of being applied in a simple manner without requiring expensive dies. The assembly also avoids the need for a foil wrap for shielding.

The novel features of the invention are set forth with particularity in the appended claims. The invention will be best understood from the following description when read in conjunction with the accompanying drawings.

BRIEF DESCRIPTION OF THE DRAWING

Fig. 1 is an isometric view of a cable harness assembly of the present invention, and also showing, in phantom lines, a portion of an IC card which it is designed to connect to.

DESCRIPTION OF THE PREFERRED EMBODIMENTS

Figure 1:
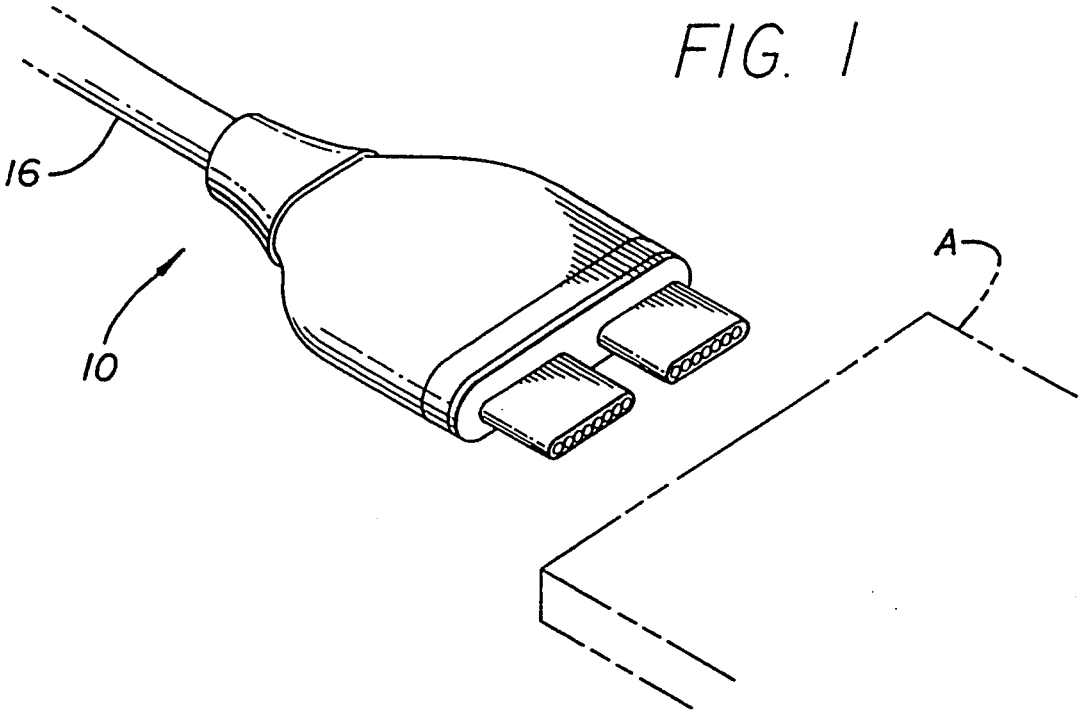

FIG. 1 illustrates a cable harness assembly 10 which is designed to connect to the rear end of an IC Card A. A standard PCMCIA card has a maximum thickness of 5 mm, so the harness assembly should be thin and of light weight to avoid applying stresses to the card.

Figure 2:
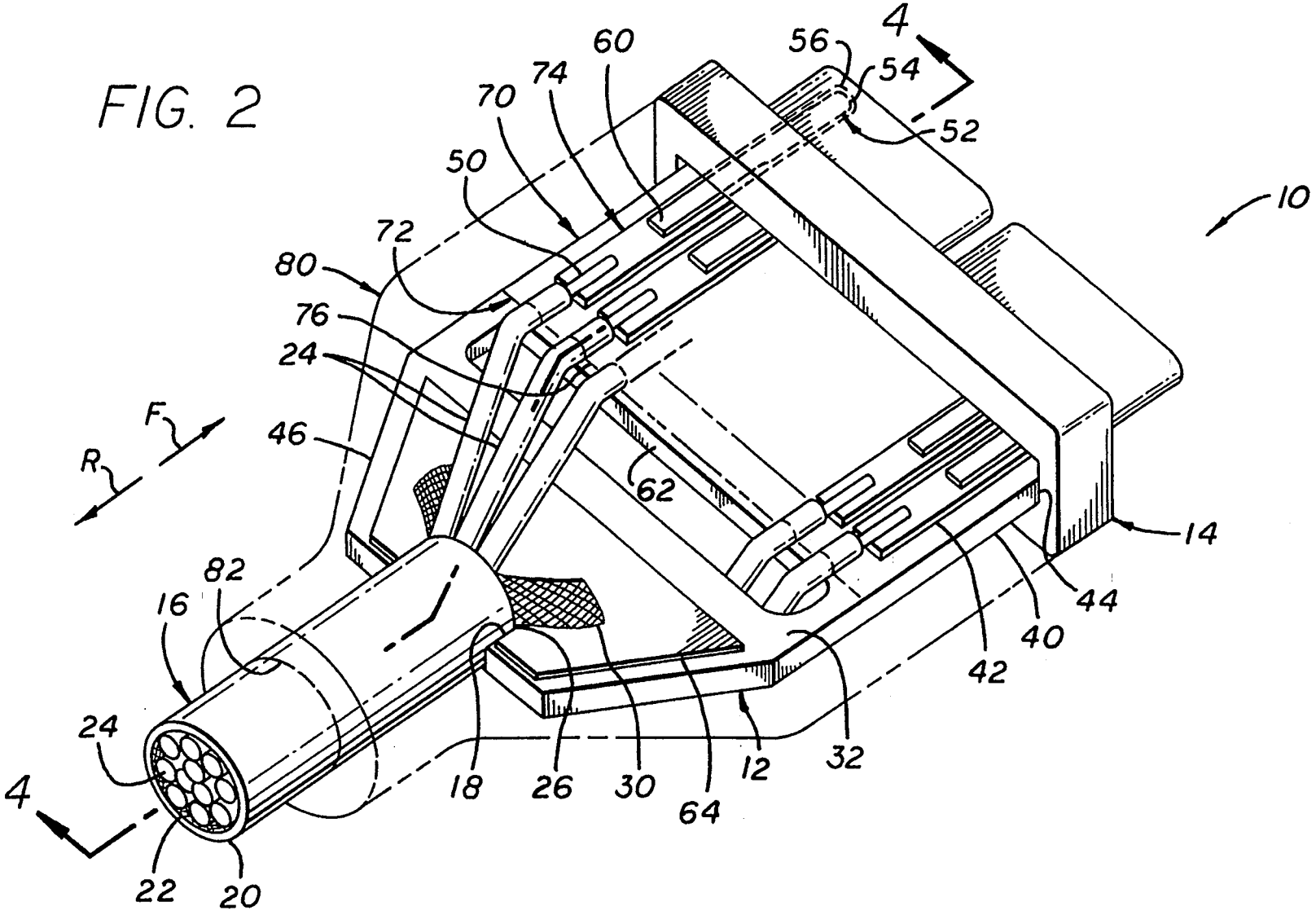
FIG. 2 is a partial isometric view of the cable harness assembly of FIG. 1, with the underlayer and overlayer shown in phantom lines.

FIG. 2 illustrates details of the assembly 10, which includes a board 12, a forward connector frame 14 lying at the front 44 of the board, and a cable 16 lying in a slot 18 at the rear of the board. The cable includes a jacket 20, a braided shield 22 lying within the jacket, and a group of insulated wires 24 lying within the shield. The cable has a stripped front end 26, with the jacket being removed forward of that location. The cable shield has an exposed portion 30 lying forward of the end 26 and dressed to the shape shown, and the wires 24 extend generally forward of that location and along an upper surface 32 of the board. The board has a front portion 40 that carries a row of conductive traces 42. The wires 24 have exposed forward ends 50 that lie on and are soldered to the conductive traces 42. A row of contacts 52 have front portions 54 lying in passages 56 of the connector frame 14, the contacts having tails 60 at their rear ends which are soldered to the traces 42. The trace-connected wire ends and tails form joints 74. It is possible to directly connect the wire forward ends 50 to the tails 60, although the presence of traces 42 is generally desirable to hold down the joints to the board. It is noted that the particular board shown has a slot 62, and some of the wires extend along the lower side of the board, and through the slot to the traces. The rear portion of the board has a grounding trace 64, and the exposed shield portion 30 is soldered to the grounding trace. The assembly shown in solid lines in FIG. 2 forms a preliminary assembly 70.

Figure 3:
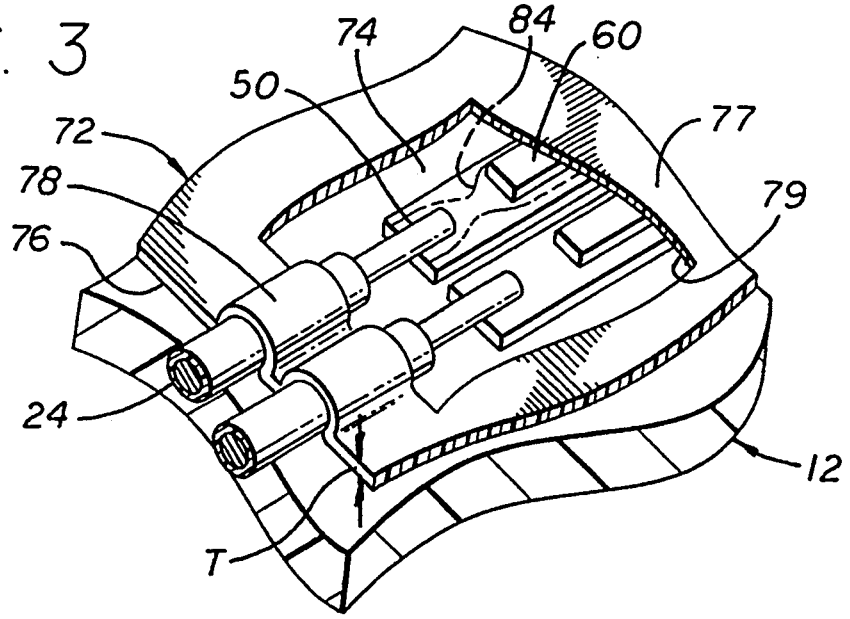
FIG. 3 is an enlarged view of a portion of FIG. 2, with the underlayer shown in solid lines.

After the preliminary assembly 70 is formed, applicant applies an underlayer 72 over the forward portion of the board, to cover the joints 74 where the wire ends 50 are connected to the tails 60 through the traces 42. The underlayer 72 also covers all exposed portions of the tails 60, exposed wires ends 50 and traces 42, and adjacent portions of the board front portion 40, and extends to a middle location 76. The underlayer is formed of insulative material, is preferably unmolded (i.e., not formed in a die that defines its upper surface), and may be brushed or sprayed on. A variety of suitable insulative materials are available for this purpose, including most short chain polymers that can be cured to a solid state. The underlayer is applied so it is in intimate contact with the joint parts and adjacent parts of the preliminary assembly, to prevent any conductive molding material from reaching the joint, as will be described below. An examination of the underlayer will show that it is unmolded, because its upper or outer surface 77 has undulations at 78 over the wires as shown in FIG. 3. This occurs because the outer surface 77 of the underlayer largely conforms to its inner surface 79, which conforms to the parts that it covers.

After the underlayer 72 is applied and cured, an overlayer 80 of electrically conductive material is molded around the preliminary assembly 70 in regions rearward of the forward connector insulator 14, to a location 82 along the fully jacketed cable. The overlayer 80 is formed of electrically conductive molded plastic material. Such material can be formed by mixing a common polymer such as heated liquid crystal plastic or an epoxy with large quantities of metal powder such as silver. Although the resistivity of such conductive moldable plastic material is typically one to four orders of magnitude greater than that of copper (which has a resistivity of 1.7 microhm-centimeter), the conductive plastic material has sufficient conductivity to provide good ESD/EMI (electrostatic discharge and electromagnetic interference) shielding. Applicant inserts the preliminary assembly 70 with the underlayer 72 applied and preferably cured, in an injection mold having the outline of the overlayer 80 indicated in FIG. 2. The electrically conductive plastic or polymer material (with conductive powder therein) is then injected into the mold to the shape shown. The assembly is removed from the mold and the overlayer cured as with ultraviolet light, to complete the assembly.

FIG. 3 shows some details of the underlayer 72. The underlayer is relatively thin, with a thickness T that is preferably no more than the outside diameter of the insulated wires 24. It is important that the underlayer 72 be in intimate contact with the parts of the joint 74, including the exposed wire ends 50 and those portions of the contact tails 60 that lie over the board 12 as well as solder indicated at 84. Of course, this is to prevent the electrically conductive plastic material of the overlayer from flowing under the underlayer 72 and directly engaging any of the exposed conductive parts of any of the joints 74. Only a relatively thin layer of underlayer material is necessary, and it can be applied easily by brushing or spraying, with spraying being preferred to provide a uniform repeatable underlayer.

Figure 4:
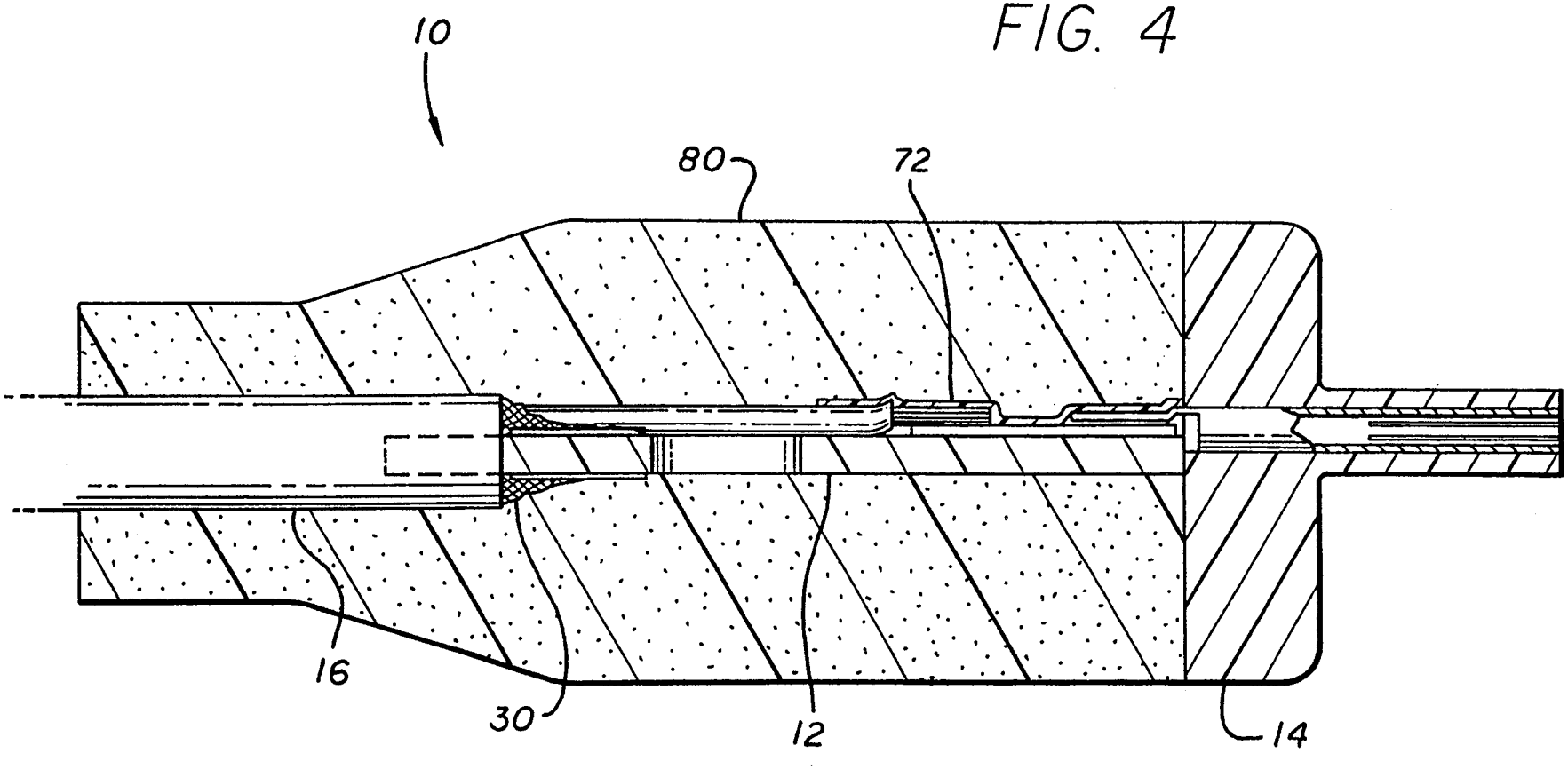
FIG. 4 is a sectional side view of the connector assembly of FIG. 2, which includes the underlayer and overlayer.

FIG. 4 shows a cross section of the final cable harness assembly 10. It can be seen that the overlayer 80 forms more than half of the volume of the assembly, especially that part of the assembly that lies outside the cable 16, board 12, and connector frame 14. The overlayer 80 preferably bonds to the parts it encapsulates. In any case, the overlayer is of thick tough material, and provides a tough assembly that holds the parts securely together against damage from blows and vibrations. The overlayer penetrates and holds to the exposed cable shield part 30 to make intimate mechanical and electrical contact therewith. As a result, the conductive overlayer 80 is maintained at the same ground potential as the cable shield. The molded overlayer 80 also forms the external surface of the assembly, and is molded to provide an attractive and generally smooth-surfaced appearance.

Figure 6:
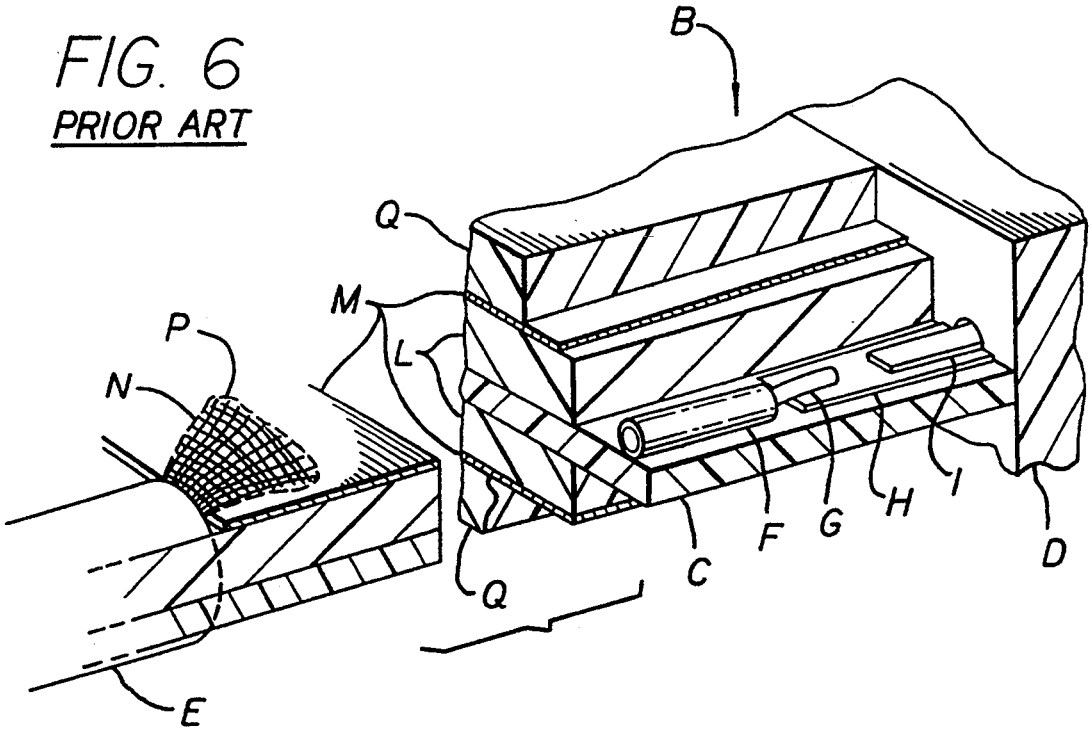
FIG. 6 PRIOR ART
FIG. 6 is a partial isometric and sectional view of a cable harness assembly constructed in accordance with the prior art.

FIG. 6 shows a prior art cable harness assembly B, which includes the circuit board C, the connector frame D at the front of the board, and the cable E at the rear of the board. The wires F of the cable have bared front ends G connected through a trace H to the contact tails I in the same manner as the assembly of FIGS. 1–4. However, after the preliminary assembly of the prior art was formed, a first insulative molded layer L was injection molded around the joints H and all exposed parts connected therewith. Then, a foil wrapper was wrapped about the insulative first molded layer L. The exposed cable shielding N was soldered at P to the foil. Finally, the assembly was placed in a second injection mold, and a second molded layer Q of insulative material was molded around the foil and formed the exterior of the assembly. This assembly required two injection moldings, of the layers L and Q, as well as the wrapping of a foil wrapper M (which was soldered to the cable shield N). All of this added expense and bulk, as well as decreasing the reliability of the final assembly. The present assembly of FIGS. 1–4, which uses only an easily applied underlayer 72 and a single molded conductive overlayer 80, reduces the cost and bulk of the assembly while increasing its reliability.

Figure 5:
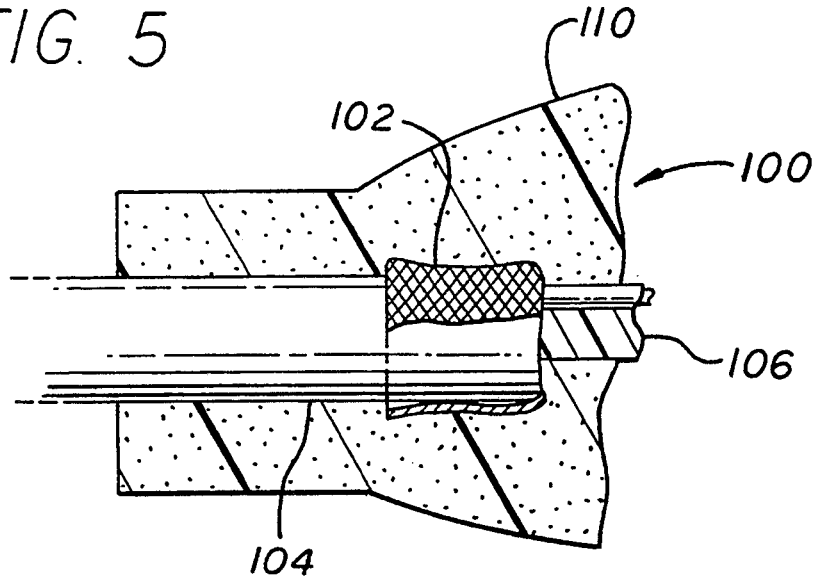
FIG. 5 is a portion of a connector assembly constructed in accordance with another embodiment of the invention.

FIG. 5 illustrates a rearward portion of a cable harness assembly 100 constructed in accordance with another embodiment of the invention. In this assembly, the cable shielding 102 is wrapped backward around the cable jacket 104 to provide a neat wrapping held in place by the rest of the cable. The cable shielding is not soldered to any grounded trace on the board 106. The electrically conductive molded overlayer 110 penetrates the wires of the cable shielding 102 to securely hold it in place while establishing good electrical contact with it.

Thus, the invention provides a cable harness assembly which can be constructed compactly and at moderate cost and which has high durability. This is accomplished by providing a relatively thin insulative underlayer (preferably unmolded) over the front portion of the board to cover the joints and expose electrically conductive parts of the wires and contact tails. An electrically conductive and largely polymer molded material forms an overlayer that is molded around the preliminary assembly to which the underlayer has been applied, to provide an electrical shield and mechanical holding of the parts while also providing the outline of the assembly. The underlayer can be applied by simple techniques, such as spraying or brushing on, so it requires minimal tooling and time to apply. Only one molded layer is require, that being the overlayer, which decreases the cost and increases the durability, while enabling a more compact assembly to be created.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A cable harness assembly which comprises a board, a cable lying at a rearward portion of said board, a connector frame lying at a forward portion of the board and having a plurality of contact-holding passages, and a plurality of contacts each having a forward portion lying in one of said passages and a rearward portion forming a tail lying over said board, said cable having a jacket with a stripped forward end and a plurality of insulated wires each extending forwardly and having an exposed forward end electrically connected to the tail of one of said contacts, characterized by:

an underlayer of electrically insulative material lying over and in intimate engagement with said contact tails and said exposed forward ends of said wires;

an overlayer which surrounds said underlayer and which forms a majority of the volume of said connector outside said connector frame, said board and said cable, said overlayer being formed primarily of electrically conductive molded plastic material.

2. The cable harness assembly described in claim 1 wherein:

said cable has a grounded shield surrounding said wires, with said shield having an exposed portion near said jacket stripped forward end, and said electrically conductive molded plastic material of said overlayer is in direct contact with said shield exposed portion.

3. The cable harness assembly described in claim 1 wherein:

a majority of the surface of said board and of wire portions lying forward of said cable jacket stripped forward end, is devoid of covering by said underlayer, but said majority of the surface is in direct contact with said overlayer.

4. The cable harness assembly described in claim 1 wherein:

said underlayer is unmolded and has an average thickness that is no more than the diameter of each of said insulated wires.

5. The cable harness assembly described in claim 1 wherein:

said underlayer is unmolded, and has an outer surface with undulations that largely conform to undulations at its inner surface.

6. A cable harness assembly which comprises a board with front and rear end portions, a connector frame coupled to said board front end portion and having a plurality of passages holding contacts with rear ends forming tails lying on said board front portion, and a cable having a forward end portion that includes a cable shield with an exposed shield portion and a plurality of insulated wires extending forward of said shield end portion and having bared front end connected to said contact tails, characterized by:

an underlayer of insulative material lying over said tails and said wire bared front ends;

a molded overlayer of electrically conductive largely polymeric material, molded around said underlayer and around said board and around said shield exposed portion, with said overlayer having a rear end lying around a cable location, with said overlayer substantially defining the outside shape of said cable harness forward of said cable location and rearward of said connector frame, and with said underlayer electrically isolating said tails and wire bared front ends from said overlayer.

7. The cable harness assembly described in claim 6 wherein:

said underlayer has an undulating upper surface corresponding to said wires.

8. A method for forming a cable harness assembly which includes stripping an insulative jacket forward of a predetermined cable location to expose a cable shield, dressing the cable shield, positioning insulated cable wires so they extend forward of the cable shield and along a board to a forward portion of the board, and forming joints that electrically connect forward ends of the wires to tails at the rear ends of contacts that lie in a connector frame at the front of the board, wherein the method also includes mechanically holding the wires and joints and a front end of the cable jacket together while providing an electrical shield that is at the same potential as the cable shield and that surrounds wire portions lying forward of the shield, characterized by:

applying an underlayer of insulative material over said joints and exposed portions of said contact tails;

applying an overlayer of electrically conductive material over said underlayer and around said board and around a front portion of said cable to surround said board and to contact and surround said cable shield and surround a front portion of said cable jacket, to thereby provide mechanical holding and electrical shielding.

9. The method described in claim 8 wherein:

said step of applying an underlayer includes applying a layer of substantially uniform thickness that has undulations at portions that lie over said wires.

10. The method described in claim 8 wherein:

said step applying said overlayer includes placing an end portion of said cable that includes said cable jacket, said board, and said joints and underlayer, in a mold and filing said mold with said electrically conductive material.

11. The method described in claim 8 wherein:

said step of applying an underlayer includes spraying material of said underlayer over said joints and part of said wires and contact tails and part of the board forward portion but not over most of the board rearward portion of said cable shield.

12. The method described in claim 8 including:

creating a ground trace on said board rear portion and soldering said cable shield to said trace;

said step of applying an underlayer includes leaving substantially all of said ground trace uncovered.

* * * * *